US010113729B2

(12) United States Patent
Knabe

(10) Patent No.: US 10,113,729 B2
(45) Date of Patent: Oct. 30, 2018

(54) CLIP ON MAILBOX LIGHTING APPARATUS

(71) Applicant: Nicolaas Knabe, Forest Lake, MN (US)

(72) Inventor: Nicolaas Knabe, Forest Lake, MN (US)

( * ) Notice: Subject to any disclaimer, the term of this patent is extended or adjusted under 35 U.S.C. 154(b) by 177 days.

(21) Appl. No.: 15/214,200

(22) Filed: Jul. 19, 2016

(65) Prior Publication Data

US 2017/0016605 A1 Jan. 19, 2017

Related U.S. Application Data

(60) Provisional application No. 62/194,251, filed on Jul. 19, 2015.

(51) Int. Cl.

| | |
|---|---|
| ***F21V 23/04*** | (2006.01) |
| ***A47G 29/122*** | (2006.01) |
| ***F21V 21/088*** | (2006.01) |
| ***A47G 29/12*** | (2006.01) |
| *F21S 9/03* | (2006.01) |

(52) U.S. Cl.

CPC ..... *F21V 23/04* (2013.01); *A47G 29/122* (2013.01); *A47G 29/1209* (2013.01); *F21V 21/088* (2013.01); *F21S 9/037* (2013.01)

(58) Field of Classification Search

CPC ... F21V 23/04; F21V 21/088; A47G 29/1209; A47G 29/122

See application file for complete search history.

(56) References Cited

U.S. PATENT DOCUMENTS

| | | | | |
|---|---|---|---|---|
| 4,755,915 | A | 7/1988 | Rogers | |
| 5,813,749 | A | 9/1998 | Sheldon | |
| 5,975,713 | A | 11/1999 | Brothers | |
| 6,033,084 | A | 3/2000 | Burke | |
| 6,102,548 | A | 8/2000 | Mantle et al. | |
| 6,601,969 | B2 | 8/2003 | Barton | |
| 6,953,258 | B1 * | 10/2005 | Goins | A47G 29/1209 362/155 |
| 2008/0257947 | A1 | 10/2008 | Guo et al. | |
| 2014/0104819 | A1 * | 4/2014 | Dowding | F21V 33/0024 362/183 |

* cited by examiner

*Primary Examiner* — Anh Mai
*Assistant Examiner* — Nathaniel Lee
(74) *Attorney, Agent, or Firm* — The Keys Law Firm PLLC

(57) ABSTRACT

A clip on mailbox lighting apparatus for providing mailbox door responsive illumination element for a mailbox comprises a device housing which includes an attachment clip, solar panel, a lighting element, a lighting switch, and an internal battery. The attachment clip and lighting element positioned on the bottom side of the device housing for use to attach to an edge of the mailbox and illuminate the interior of the mailbox, respectively, and the solar panel positioned on the top side of the device housing where it can be exposed to the sky. Through internal wiring, the lighting element electrically connected to the internal battery by way of the lighting switch. In this regard, the lighting switch operates to direct electricity to the lighting element when the mailbox is open.

10 Claims, 2 Drawing Sheets

CLIP ON MAILBOX LIGHTING APPARATUS

CROSS REFERENCE TO RELATED APPLICATIONS

This application claims the benefit of and incorporates by reference U.S. provisional patent application Ser. No. 62/194,251 filed Jul. 19, 2015.

BACKGROUND OF THE INVENTION

Field of the Invention

This invention relates generally to notification devices and, more particularly, to a solar powered, clip on mailbox lighting apparatus that is responsive to the mailbox door opening.

Description of the Prior Art

The use and design of conventional mailboxes is well known. A problem which still exists, however, is that for those who retrieve items from their mailbox at night or when visibility is otherwise limited by a lack of light, it is often difficult to retrieve and review their mail while still at the mailbox. While one could bring a handheld lighting element with them when retrieving their mail, holding such an item may make it more difficult to retrieve and sift through their mail. Thus, there remains a need for a mailbox lighting apparatus which can provide a hands free source light to a mailbox area. It would be helpful if such a mailbox lighting apparatus was adapted to be removably attached to a mailbox through a clip mechanism for ease of installation and replacement. It would be additionally desirable for such a clip on mailbox lighting apparatus was structured to automatically illuminate whenever the mailbox to which it was clipped was in the open position.

The Applicant's invention described herein provides for a clip on mailbox lighting apparatus adapted to automatically illuminate whenever the mailbox to which it is attached is open. The primary components in Applicant's clip on mailbox lighting apparatus are an attachment clip, a solar panel, a lighting element, a battery and a spring loaded lighting switch. When in operation, the clip on mailbox lighting apparatus provides a mounted, solar powered lighting source which requires no additional manual actuation to supply light when needed. As a result, many of the limitations imposed by prior art structures are removed.

SUMMARY OF THE INVENTION

A clip on mailbox lighting apparatus for providing mailbox door responsive illumination element for a mailbox. The clip on mailbox lighting apparatus comprises a device housing which includes an attachment clip, solar panel, a lighting element, a lighting switch, and an internal battery. In one embodiment, the device housing is configured to be placed on top of a mailbox, with the attachment clip and lighting element positioned on the bottom side of the housing for use to attach to an edge of the mailbox and illuminate the interior of the mailbox, respectively, and the solar panel positioned on the top side of the device housing where it can be exposed to the sky. Through internal wiring, the lighting element electrically connected to the internal battery by way of the lighting switch. In this regard, the lighting switch operates to direct electricity to the lighting element when the mailbox is open.

It is an object of this invention to provide a mailbox lighting apparatus which can provide a hands free source light to a mailbox area.

It is another object of this invention to provide a mailbox lighting apparatus adapted to be removably attached to a mailbox through a clip mechanism for ease of installation and replacement.

It is yet another object of this invention to provide a clip on mailbox lighting apparatus structured to automatically illuminate whenever the mailbox to which it was clipped was in the open position.

These and other objects will be apparent to one of skill in the art.

DETAILED DESCRIPTION OF THE INVENTION

Figure 1:
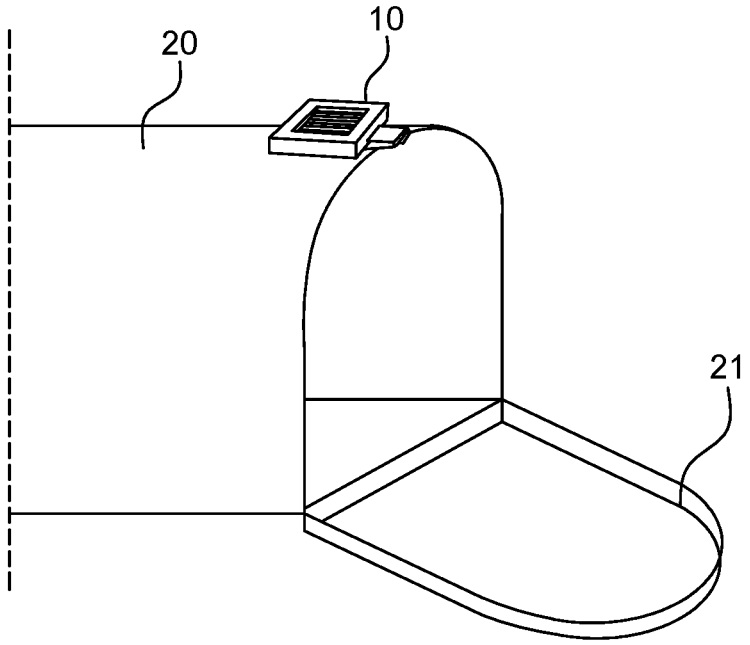
FIG. 1 is a side perspective view of a clip on mailbox lighting apparatus built in accordance with the present invention in place on a conventional mailbox.
Figure 2:
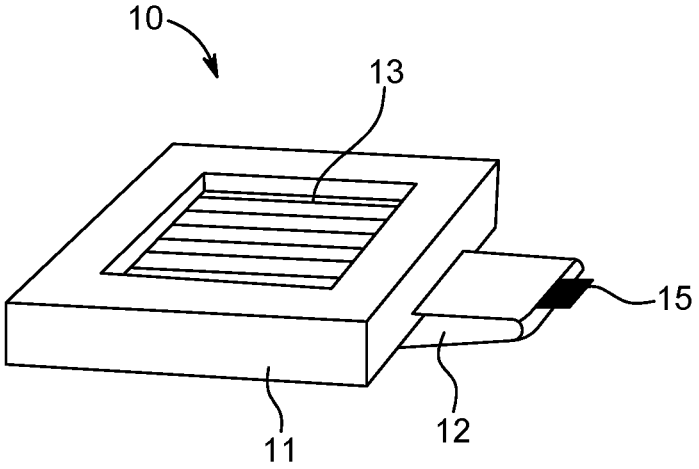
FIG. 2 is a side perspective view of a clip on mailbox lighting apparatus built in accordance with the present invention.
Figure 3:
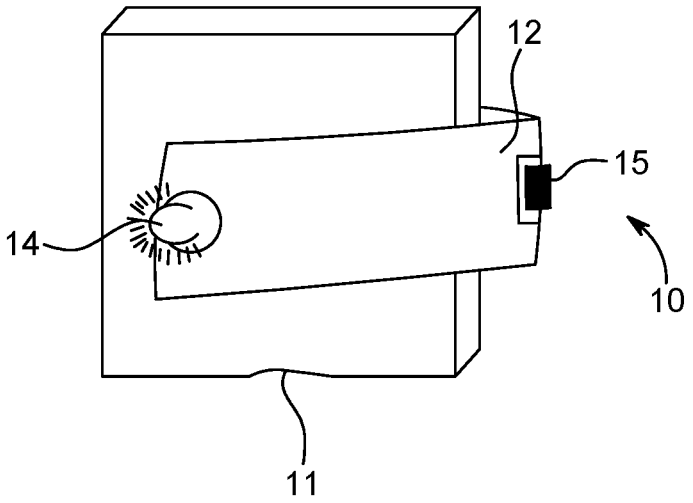
FIG. 3 is a bottom perspective view of a clip on mailbox lighting apparatus built in accordance with the present invention.

Referring now to the drawings and in particular FIGS. 1, 2, and 3, a clip on mailbox lighting apparatus 10 is shown as a device housing 11 which includes an attachment clip 12, solar panel 13, a lighting element 14, a lighting switch 15, and an internal battery (not shown). In the preferred embodiment, the attachment clip 12 is positioned to extend beneath the device housing 11 and the solar panel 13 is positioned on top of the device housing 11, thereby configuring the device housing 11 to be placed on top of a conventional mailbox 20 with the solar panel 13 exposed to the sky. In alternate embodiment, the attachment clip 12 and solar panel 13 may be positioned in varying locations so as to ensure the solar panel 13 is exposed to the sky if, for various mailbox designs, the device housing 11 is to be placed on a side of the mailbox.

It is appreciated that in the preferred embodiment, the lighting element 14 is positioned on the attachment clip 12 because when the device housing is mounted on the mailbox 20, the much of the attachment clip 12 will be inside the mailbox 20 (with the solar panel 13 outside).

It is understood that the solar panel 13 is operatively connected to the internal battery such that electricity generated by the solar panel 13 is supplied to the internal battery to be stored for later use. Accordingly, it is appreciated that in some embodiments, a conventional charge controller (not shown) is employed to protect the internal battery from overcharging and from discharging at night.

Through internal wiring, the lighting element 14 electrically connected to the device housing's internal battery through the lighting switch 15. In the preferred embodiment, the lighting element 14 defines a conventional LED bulb and the lighting switch 15 defines a spring-loaded pressure sensitive on/off switch. In this regard, the lighting switch is operative to cause electricity to be supplied to the lighting element 14 when switch is released (which closes the circuit to the lighting element 14) and interrupt the flow of electricity to the lighting element 14 while the switch is held (opening the circuit). In the preferred embodiment, the lighting switch 15 is positioned on the device housing 11 so that it is held when a door on the mailbox is closed and released whenever the door 21 on is moved from its closed position.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A clip on mailbox lighting apparatus, comprising:

a device housing having a top side, a bottom side, a front surface, and a power source;

an attachment device integral with said device housing, wherein said attachment device defines a spring biased clip which extends below said bottom side, thereby adapting the device housing to be removably attached to a mailbox having a door with the attachment device extending into the interior of the mailbox and the device housing not extending into the interior of the mailbox;

a lighting element integral with said attachment device, positioned such that when the device housing is attached to the mailbox with the attachment device extending into the interior of the mailbox, the lighting element illuminates the interior of the mailbox when supplied with electricity;

a switching element integral with said device housing, positioned such that when the device housing is attached to the mailbox with the attachment device extending into the interior of the mailbox, the mailbox door contacts the switching element only when closed so as to actuate the switching element; and wherein said switching element is configured to interrupt the flow of electricity from the power source to the lighting element when actuated.

2. The clip on mailbox lighting apparatus of claim 1, wherein said switching element extends beyond the front surface.

3. The clip on mailbox lighting apparatus of claim 1, wherein said switching element defines a spring-loaded pressure sensitive on/off switch.

4. The clip on mailbox lighting apparatus of claim 3, wherein said solar panel is integral with the top side.

5. The clip on mailbox lighting apparatus of claim 1, additionally comprising a solar panel integral with said device housing and electrically interconnected with said power source, switching element, and lighting element.

6. The clip on mailbox lighting apparatus of claim 1, wherein said switching element extends from the attachment device beyond the front surface.

7. A clip on mailbox lighting apparatus, comprising:

a device housing having a top side, a bottom side, a front surface, and a power source;

an attachment device integral with said device housing, wherein said attachment device defines a spring biased clip which extends beyond the front surface and below said bottom side, thereby adapting the device housing to be removably attached to a mailbox having a door with the attachment device extending into the interior of the mailbox and the device housing not extending into the interior of the mailbox;

a lighting element integral with said attachment device, positioned such that when the device housing is attached to the mailbox with the attachment device extending into the interior of the mailbox, the lighting element illuminates the interior of the mailbox when supplied with electricity;

a switching element integral with said device housing, positioned to extend beyond said front surface such that when the device housing is attached to the mailbox with the attachment device extending into the interior of the mailbox, the mailbox door contacts the switching element only when closed so as to actuate the switching element; and wherein said switching element is configured to interrupt the flow of electricity from the power source to the lighting element when actuated.

8. The clip on mailbox lighting apparatus of claim 7, additionally comprising a solar panel integral with said top side and electrically interconnected with said power source, switching element, and lighting element.

9. The clip on mailbox lighting apparatus of claim 8, wherein said switching element defines a spring-loaded pressure sensitive on/off switch.

10. The clip on mailbox lighting apparatus of claim 8, wherein said switching element is positioned to extend from the attachment device beyond said front surface.

* * * * *